US006575241B2

(12) United States Patent
Widney et al.

(10) Patent No.: US 6,575,241 B2
(45) Date of Patent: Jun. 10, 2003

(54) DOWNHOLE COMMUNICATION APPARATUS

(75) Inventors: Scott W. Widney, New Sarepta (CA); Richard L. Dedels, Edmonton (CA); Emanuel Kulhanek, Surrey (CA)

(73) Assignee: C-Tech Energy Services, Inc., Edmonton (CA)

( * ) Notice: Subject to any disclaimer, the term of this patent is extended or adjusted under 35 U.S.C. 154(b) by 0 days.

(21) Appl. No.: 09/893,235

(22) Filed: Jun. 26, 2001

(65) Prior Publication Data

US 2002/0066575 A1 Jun. 6, 2002

(51) Int. Cl.[7] ..... E21B 17/00

(52) U.S. Cl. ..... 166/242.2; 166/242.1; 166/385; 138/128; 138/104

(58) Field of Search ..... 166/242.1, 242.2, 166/242.3, 385, 380; 175/320; 138/104, 128, 169

(56) References Cited

U.S. PATENT DOCUMENTS 3,191,450 A * 6/1965 Wilson ..... 173/197
3,559,905 A * 2/1971 Palynchuk ..... 166/77.3
4,202,087 A * 5/1980 Wilderman ..... 166/243
4,612,984 A 9/1986 Crawford ..... 166/77
4,682,657 A 7/1987 Crawford ..... 166/385
4,848,455 A * 7/1989 Fenyvesi ..... 166/237
5,244,046 A 9/1993 Council et al. ..... 166/380
5,348,097 A 9/1994 Giannesini et al. ..... 166/385
5,565,653 A * 10/1996 Rofidal et al. ..... 174/113 R
5,803,170 A * 9/1998 Garcia-Soule et al. ... 166/241.6
5,890,534 A * 4/1999 Burge et al. ..... 166/77.3
5,947,198 A 9/1999 McKee et al. ..... 166/66.4
6,209,632 B1 * 4/2001 Holbert et al. ..... 166/242.6
6,279,363 B1 * 8/2001 Averbuch et al. ..... 72/11.1
6,289,986 B1 * 9/2001 Wright et al. ..... 166/117.7
6,293,347 B1 * 9/2001 Cahill ..... 166/105

* cited by examiner

*Primary Examiner*—William Neuder
*Assistant Examiner*—T. Shane Bomar
(74) *Attorney, Agent, or Firm*—Joseph W. Holland

(57) ABSTRACT

A device for moving a tool lengthwise in a passageway such as a pipe or oil well hole, with a power or signal conduit connected between the tool and outside of the passageway, consists of a solid rod with a groove along the rod's length, the groove extending inwards from the rod outer surface. The conduit is installed in the groove. The device can also be used to rotate the tool in the passageway.

9 Claims, 3 Drawing Sheets

DOWNHOLE COMMUNICATION APPARATUS

FIELD OF THE INVENTION

This invention relates to means for transporting tools and instruments to locations inside pipes, well holes and other such passageways, and to means for providing power or data connections to these tools.

BACKGROUND OF THE INVENTION

There are many applications in which it necessary to transport a tool or instrument far into a narrow passageway such as an oil well hole, a pipeline or a waterline, and in which an energy or information transmitting conduit such as an electrical cable is connected to the tool and extends outside the passageway. The passageways may be not be vertical, and they may curve along their length. Therefore the means for moving the tool will have to be able to exert a lengthwise force on the tool, both pushing it into and pulling it out of the passageway. The means must also be flexible enough to accommodate the passageway curves.

A method typically used in oil and gas wells is to connect the tool to flexible tubing, with the conduit inside the tubing. The conduit is housed in a flexible polymer rod, the rod in turn being centered inside the tubing.

Such a flexible tubing system has disadvantages which include high manufacturing costs and problems related to the strength of the flexible tubing. The tubing can be crushed or its inner channel pinched off if bent too sharply. Both crushing and pinching off can sever the conduit. The flexible tubing has limited axial strength. Tubing often has a short stress cycle life, so it can be used for only a few well servicings. The conduit cannot be accessed for inspection or repair without cutting into the tubing.

There are also applications in which is desirable to have a conduit connected to equipment far into the passageway, while also having a rigid connection transmitting the force required to operate the equipment. An example is a downhole oil well pump, in which a downhole piston is connected to drive gear at the surface by a solid metal sucker rod. The surface gear moves the downhole piston up and down through the sucker rod. It would be useful to monitor pressure or other properties at the downhole piston while the pump is operating. Another example is pipe or tubing that rotates a tool, such as a drilling tool, in a passageway, for which it would be useful to monitor properties at the tool while it is rotating.

SUMMARY OF THE INVENTION

This invention seeks to overcome problems with the prior art. According to an aspect of the invention, there is provided a device for moving equipment. The device comprises a rod having a groove set in it extending along the length of the rod. A groove extends along the rod and inward into the rod from the rod outer surface. A transmission conduit extends along the rod within the groove. According to further aspects of the invention, the groove is wider deeper in the groove than at the rod outer surface and the groove width at the rod outer surface is smaller than the diameter of the transmission conduit.

The transmission conduit should be sealed in the groove against fluid flow along the groove between the transmission conduit and the groove in any case where pressure may be a problem. Preferably, the transmission conduit is sealed in the groove by a sealant, and the sealant occupies all of the groove that is not occupied by the transmission conduit.

The device is typically used in combination with a rod actuator coupled to the rod for moving and positioning the rod. The rod actuator may be a rod injector or rod rotator.

According to a further aspect of the invention, the rod has an elongated cross-section defining a curved rod outer surface, and the groove is located where the longest cross-section diameter intersects the surface. The rod may have a cross-section forming the shape of an ellipse having a major axis, and the groove is located where the major axis intersects the rod surface.

According to a further aspect of the invention, there is provided apparatus for use in a well, the apparatus comprising a rod having an outer surface, the rod extending between a first end and a second end, a downhole tool being mounted on the first end of the rod, the second end of the rod being outside the well, a groove along the rod between the first and second ends and extending inward from the rod outer surface, a transmission conduit extending along the rod and sealed within the groove, the transmission conduit being connected to the downhole tool and extending to the second end of the rod, and a rod actuator coupled to the rod for moving the rod and downhole tool in the well.

According to a further aspect of the invention, there is provided a method for installing a transmission conduit in a groove along the length of a rod, the rod having an outer surface and the groove extending inward from the rod outer surface, comprising the steps of:

installing the transmission conduit in the groove from the rod outer surface; and sealing the rod in the groove.

According to a further aspect of the invention, there is provided the method step of reducing the groove width at the rod outer surface so the transmission conduit is retained in the groove.

BRIEF DESCRIPTION OF THE DRAWINGS

There will now be described preferred embodiments of the invention, with reference to the drawings, by way of illustration only and not with the intention of limiting the scope of the invention, in which like numerals denote like elements and in which.

DETAILED DESCRIPTION OF PREFERRED EMBODIMENTS

In this patent document, "comprising" means "including". In addition, a reference to an element by the indefinite article "a" does not exclude the possibility that more than one of the element is present.

Figure 1:
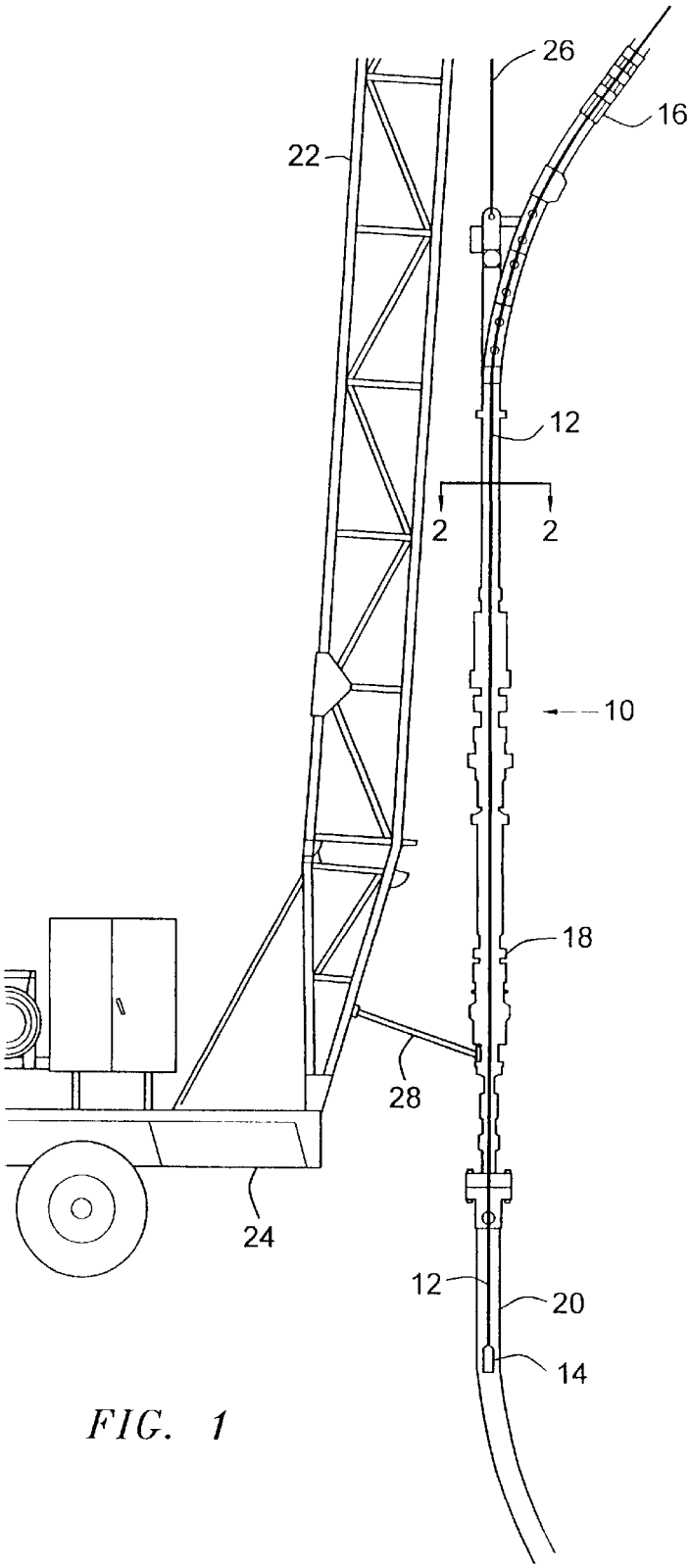
FIG. 1 is a schematic of the invention and shows it used for the particular application of downhole servicing of an oil or gas well.

FIG. 1 shows a preferred embodiment of the invention 10 used for servicing an oil or gas well downhole. A continuous rod 12 is attached to a well tool or instrument 14. A guide 16 positions the rod 12 at the well hole entrance. A rod injector 18 at the entrance to the well hole 20 feeds the rod 12 into or out of the well hole 20. The rod injector 18 is preferably a modified caterpillar flexible tubing injector, which uses flexible belts to effect the traction and thrust necessary to hold and move the rod 12. Various caterpillar rod injectors are known in the art and need not be further described here. The guide and rod injector are supported and positioned by the mast 22 on the service truck 24. The guide is suspended from the mast by a cable 26 and the rod injector 18 is mounted to the mast 22 by a strut 28. Various forms of rod actuator may be used to move the rod within a well, such as a rod injector, or, as described below, a rod rotator.

Figure 2:
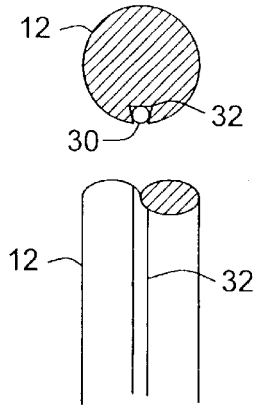
FIG. 2 is a lengthwise cross-section view of the rod.
Figure 3:
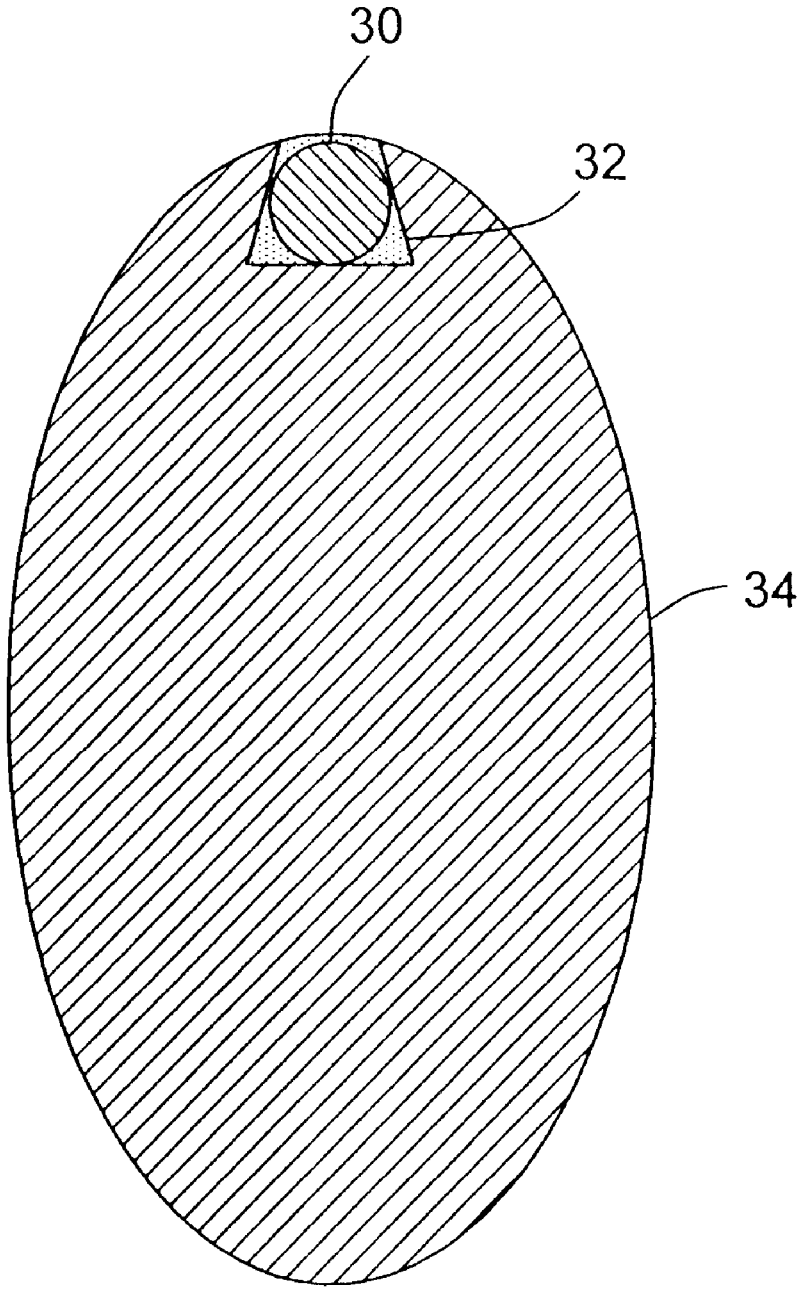
FIG. 3 is a lengthwise cross-section view of the rod.

The cross section of the rod 12 is shown in FIG. 2. The conduit 30 is housed in a groove 32 extending radially inward from the outer surface of the rod 12. The groove width is narrower at the rod 12 outer surface, and is wider towards the center of the rod 12. The groove 32 can be made by machining or milling a cut or cuts into the rod 12. The rod shown has a circular cross section, however other cross section shapes can be used to suit the application. FIG. 3 shows an elliptical cross section rod 34, with a groove 32 at the tightest curvature region of the surface. The rod 12 can also be hollow centered, it strength requirements so allow.

The conduit 30 is installed in the groove 32 by inserting it at the rod 12 outer surface. The rod 12 is then cold rolled to reduce the groove width at the outer surface and thereby trap the conduit 30 in the groove 32. The width of the groove 32 at the rod outer surface is therefore preferably the minimum that will allow the conduit 30 to be so inserted. For a flexible conduit 30, the width of the groove 32 at the outer surface should be the same as or slightly smaller than the conduit 30 outer dimension. A hardenable sealant is then injected into the groove 32, so it fills and forms a seal in the remaining volume in the groove 32. Such sealing prevents fluid from leaking lengthwise via the groove, and is required in oil and gas wells for blow-out protection. The hardenable material is a viscous liquid when injected, and it then hardens to a semi-rigid or plastic state. A preferred sealant is Permatex™ Form-A-Gasket™, manufactured by Loctite Canada Inc., specification #81310, a silicon, room temperature vulcanizing compound. It will maintain sealing to about 300° C. Oil and gas well downhole equipment typically encounters high temperatures. Other room temperature vulcanizing compounds can be used, also. The hardenable sealant can also help hold the conduit 30 in the groove 32.

The conduit 30 can be any type that will transmit energy or information. Conduit types therefore include electrical power cable, electrical signal cable, fibre optic cable, and hydraulic line.

This device improves upon the problems discussed above for coiled tubing. The rod is much more resistant to crushing or pinching off. The rod has much higher axial strength, so it can be used in more applications and has a longer life. Manufacturing costs are lower for the rod. The conduit is accessible for inspection and maintenance, and faulty conduit sections can be more easily repaired.

The rod is stored on spools similar to those for coiled tubing. Rod material used includes 41-30 steel. Other materials would be suitable, providing they have the required flexibility and axial strength, and the required groove can be made in them.

Figure 4:
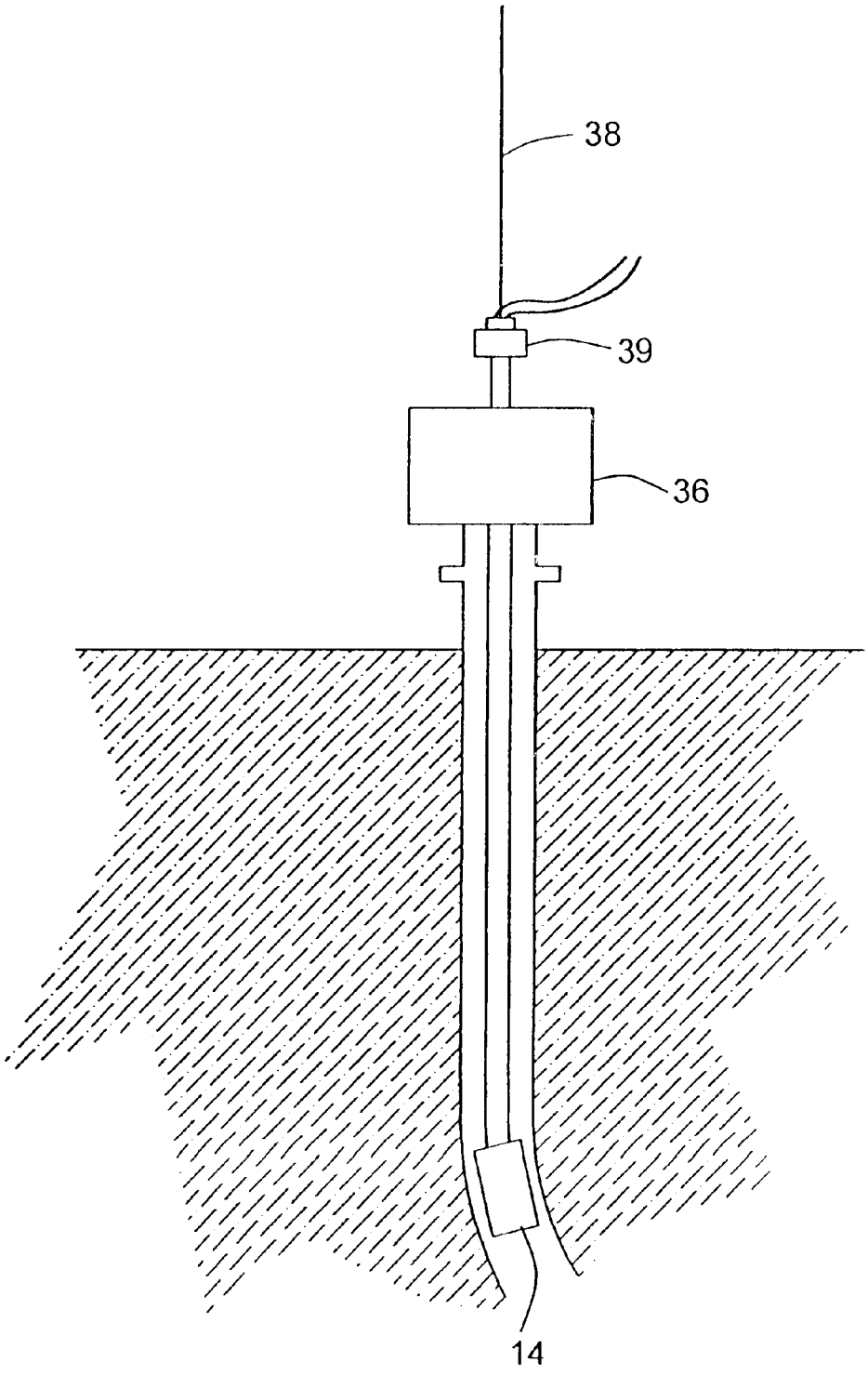
FIG. 4 is a schematic a preferred embodiment of the invention comprising equipment at the well hole entrance for rotating the rod.

The grooved rod and conduit embodiment may be used for transmitting force or torque to operate a downhole tool, as discussed above. It may be used as the sucker rod for a downhole oil well pump, in which the conduit would transmit downhole pressure transducer signals to the surface while the pump is operating. FIG. 4 shows an embodiment for rotating a downhole tool 14. The rotation gear 36 is used to rotate the rod 12, which in turn rotates the downhole tool 14 about its longitudinal axis 38. A drive head can be used as the rotating gem. A drive head comprises a motor that rotates a rotating table using belt or worm gear coupling. The rotating table is mounted on the rod 12, co-axially with the rod longitudinal axis 38. Drive heads and other rotation gear are known in the art and need not be further described here. A slip ring assembly 39 can be used for an electrical connection to the conduit 30. A rotating seal can be used for a connection to a hydraulic line in the conduit 30. Slip ring assemblies, rotating seals and other such electrical and fluid line connections are known in the art and need not be further described here.

The grooved rod and conduit embodiment has other applications besides use in passageways. It is useful in any application where the problems such as tangling would be caused by the conduit contacting other equipment. It is also useful for protecting conduit from sharp objects and other such hazards.

A person skilled in the art could make immaterial changes to the exemplary embodiments described here without departing from the essence of the invention that is intended to be covered by the scope of the claims that follow.

The embodiments of the invention in which an exclusive property or privilege is claimed are defined follows:

1. A device for moving equipment, the device comprising:

a rod extending between a first end and a second end and having an outer surface;

a groove extending along the rod between the first end and the second end, and the groove extending inward into the rod from the outer surface;

a transmission conduit extending along the rod within the groove; and the transmission conduit being sealed in the groove by a sealant against fluid flow along the groove between the transmission conduit and the groove.

2. The device of claim 1 in which the groove widens towards the center of the rod.

3. The device of claim 1 in which the groove width at the rod outer surface is smaller than the diameter of the transmission conduit.

4. The device of claim 1 in which the sealant occupies all of the groove that is not occupied by the transmission conduit.

5. The device of claim 1 in combination with a rod actuator coupled to the rod for moving and positioning the rod.

6. The device of claim 5 in which the rod actuator is a rod injector.

7. The device of claim 5 in which the rod actuator is a rod rotator.

8. The device of claim 1 in which the rod has an elongated cross-section defining a curved rod outer surface, and the groove is located where the longest cross-section diameter intersects tile surface.

9. The device of claim 8 in which the rod has a cross-section forming the shape of an ellipse having a major axis, and the groove is located where the major axis intersects the rod surface.

* * * * *